US008720452B2

(12) United States Patent
Askander et al.

(10) Patent No.: US 8,720,452 B2
(45) Date of Patent: May 13, 2014

(54) HAIR PIECE DEVICE

(75) Inventors: Mansur Askander, Bloomfield Hills, MI (US); Souhayla Denha, Bloomfield Hills, MI (US)

(73) Assignee: Angelo Ausi, Bloomfield Hills, MI (US)

( * ) Notice: Subject to any disclaimer, the term of this patent is extended or adjusted under 35 U.S.C. 154(b) by 0 days.

(21) Appl. No.: 13/373,236

(22) Filed: Nov. 8, 2011

(65) Prior Publication Data

US 2013/0298928 A1 Nov. 14, 2013

(51) Int. Cl.

| | |
|---|---|
| ***A41G 5/00*** | (2006.01) |
| ***A41G 3/00*** | (2006.01) |
| ***A45D 8/38*** | (2006.01) |
| ***A45D 24/30*** | (2006.01) |

(52) U.S. Cl.

USPC ..... 132/105; 132/106; 132/107; 132/53; 132/54

(58) Field of Classification Search

USPC ..... 132/116, 200, 201, 212, 213.1, 219, 132/105–108, 144, 148, 273, 274, 275, 278, 132/110, 53–56; 2/171.1, 171.5, 209.13, 2/204.14; D2/865, 866; D28/21, 32, 39, D28/92, 93, 74

See application file for complete search history.

(56) References Cited

U.S. PATENT DOCUMENTS

| | | | | | |
|---|---|---|---|---|---|
| 250,967 | A * | 12/1881 | Presser | 132/105 |
| 459,000 | A * | 9/1891 | Emery | 132/105 |
| 464,559 | A * | 12/1891 | Emery | 132/105 |
| 739,560 | A * | 9/1903 | Roehm et al. | 132/106 |
| 754,206 | A * | 3/1904 | Edgar | 132/106 |
| 779,413 | A * | 1/1905 | Damon | 132/106 |
| 794,479 | A * | 7/1905 | Austin | 132/105 |
| 1,346,718 | A * | 7/1920 | Muller | 132/53 |
| 1,450,491 | A * | 4/1923 | Damon | 132/106 |
| 1,594,741 | A * | 8/1926 | Lewis | 132/105 |
| 1,775,209 | A * | 9/1930 | Oppenheim | 132/105 |
| 2,303,643 | A * | 12/1942 | Illingworth | 132/119 |
| 2,497,983 | A * | 2/1950 | Fabis | 132/147 |
| 2,651,310 | A * | 9/1953 | Selson | 132/274 |
| 3,156,999 | A * | 11/1964 | Dean et al. | 446/319 |
| 3,485,249 | A * | 12/1969 | Mast | 132/53 |
| 6,019,107 | A * | 2/2000 | Overmyer et al. | 132/53 |
| 6,035,861 | A * | 3/2000 | Copello | 132/201 |
| 6,386,205 | B2 * | 5/2002 | Sartena | 132/53 |
| 6,766,805 | B1 * | 7/2004 | Cupp | 132/53 |
| 6,962,157 | B2 * | 11/2005 | Lee et al. | 132/53 |
| 7,472,708 | B2 * | 1/2009 | Eigenbrod et al. | 132/55 |
| 7,484,512 | B2 * | 2/2009 | Martinelli et al. | 132/55 |
| 8,347,895 | B2 * | 1/2013 | Campbell Rose | 132/114 |
| 8,453,654 | B2 * | 6/2013 | Munoz | 132/106 |
| 2007/0084477 | A1 * | 4/2007 | Tony Chayeb | 132/54 |

(Continued)

*Primary Examiner* — Vanitha Elgart

(74) *Attorney, Agent, or Firm* — Inventa Capital PLC

(57) ABSTRACT

A hair piece of the present invention includes a comb portion formed from a flexible polymeric material. The comb includes a top portion presenting a track or female connector and a plurality of teeth extending radially from the top portion for engaging hair of a user. The comb may be fabricated from many other materials in addition to polymeric material or combination thereof without limiting the scope of the present invention. A base or support portion of the hair piece is formed from another polymeric material such as foam or the like. The base portion may present various cross sections such as circular, rectangular, square, and the like. The base portion may present various length and heights as desired by the user. A human or synthetic hair of various shapes, styles and colors is connected to the base portion thereby totally covering the base portion.

3 Claims, 3 Drawing Sheets

(56) References Cited

U.S. PATENT DOCUMENTS

2008/0017210 A1* 1/2008 Eaton ..... 132/105
2010/0170524 A1* 7/2010 Kimura ..... 132/54
2011/0036368 A1* 2/2011 Park ..... 132/54
2011/0036370 A1* 2/2011 Lee ..... 132/201
2011/0253165 A1* 10/2011 Kenna ..... 132/273
2012/0266903 A1* 10/2012 Devlin ..... 132/54

* cited by examiner

HAIR PIECE DEVICE

FIELD OF THE INVENTION

The present invention relates generally to a hair piece and a comb attached thereto.

BACKGROUND OF THE INVENTION

The use of hairpieces is known in the prior art. People who desire to have more puffy hair appreciate use of such hair pieces. Some people like to change hair styles on daily bases. The others like to change hair color or at least style their hair with combination of at least two colors or shades. These prior art hair pieces heretofore devised and utilized are known to consist basically of familiar, expected and obvious structural configurations, which have been developed for the fulfillment of countless objectives and requirements.

The art of hair piece designs is replete with various designs and methods. U.S. Pat. No. 3,433,235 to Doolittle describes a semi-spherical wig which is releasably secured to the user's hair by a comb which is attached to the wig. The comb, however, is of conventional construction and the force with which it establishes engagement is a function of the quantity or amount of the user's hair. In other words, if there is little natural hair, the comb taught by the U.S. Pat. No. 3,433,235 to Doolittle is ineffective in firmly holding the wig in place.

Another prior art patent, such as U.S. Pat. No. 1,346,718 to Muller also describes a combination wig and comb, in which the comb is attached to a circumferential edge of the wig. Here also, however, the firmness by which the wig is held in place in achieved by the comb, and the comb, in turn, will hold the wig firmly in place only if there is an abundant amount of natural hair to achieve this result.

Still another prior art patent, such as U.S. Pat. No. 2,547,295 to Weeks is related to a hair retaining devise, designated 10 therein which is capable of expanding and contracting and is used by the U.S. Pat. No. 2,547,295 to Weeks in much the same manner as a headband. That is, it is described as being worn flat on the outside of the user's hair and in this position holding the user's hair in place. This expandable and contractible devise of the U.S. Pat. No. 2,547,295 to Weeks, however, provided, at least in one embodiment, with points along one edge which are capable of being inserted, and thereby engaging with, the natural hair of the user. This function is never realized however since, as already noted, the band 10 of U.S. Pat. No. 2,547,295 to Weeks is illustrated and described as being worn flat and in an unengaged condition with respect to the natural hair of the user.

Alluding to the above, U.S. Pat. No. 4,788,991 Nocera, et al. teaches a device wherein natural or synthetic hair is attached to a semi-spherical stretchable net-like fabric body to the circumferential end of which is attached a flat, flexible and stretchable serpentine comb. Upon attachment to the circumferential edge, the comb assumes a circular configuration wherein the tines extend radially and the comb lies substantially flat in the plane of the circumferential edge of the body.

Hence, there is a need for an improved hair piece device that will allow the user to change, as the user desires, the color, shape, and the length of the hair in addition to the hair of the user. The inventive concept as set forth further below improves the aforementioned prior art systems and methods.

SUMMARY OF THE INVENTION

A hairpiece of the present invention includes a comb portion formed from a flexible polymeric material. The comb includes a top portion presenting a track or female connector and a plurality of teeth extending radially from the top portion for engaging hair of a user. The female connector may include various configurations such as, for example, a circular, rectangular, or, as most preferred by the scope of the present invention—a dove tail configuration to provide better retaining mechanism as will be described in detailed further below. The comb may be fabricated from many other materials in addition to polymeric material or combination thereof without limiting the scope of the present invention.

A base or support portion of the hair piece is formed from another polymeric material such as foam or the like. The base portion may present various cross sections such as circular, rectangular, square, and the like. The base portion may present various length and heights as desired by the user. The base portion includes a bottom presenting a rail or a male connector to slidably engage within the female connector or track defined in the top portion of the comb. The male connector may include various configurations such as, for example, a circular, rectangular, or, as most preferred by the scope of the present invention—a dove tail configuration to provide better retaining mechanism as the male connector of the base portion is slidably disposed within the female connector or track of the top portion of the comb.

A human or synthetic hail of various shapes, styles and colors is connected to the base portion thereby totally covering the base portion. Numerous base portions may be utilized with the comb of the present invention. As the height, shape and length of the base portion changes so does the color, style, and shape of hair. The single comb portion may be used with the base portions and hair having various heights, styles, colors, and the like thereby providing the user with flexibility and choices not appreciated and realized by other prior art designs.

An advantage of the present invention is to provide a hair piece device that the user to selectively change as the user desires, the color, shape, and the length of the hair in addition to the hair of the user.

Another advantage of the present invention is to provide an improved set that will use a single comb portion and a plurality of base portions presenting various heights, length, shapes, and hair colors and styles thereby preventing the user to go to hairdresser every time the user wants to change the hairstyle thereby saving tremendous amounts of money by simply purchasing one set that includes a single comb portion and a plurality of base portions.

Still another advantage of the present invention is to provide the comb portion and the base portions that are easy to use, light in weight, and cost effective in manufacturing production.

Still another advantage of the present invention is to provide the comb portion and the base portions that can be used by adults and children of all genders.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
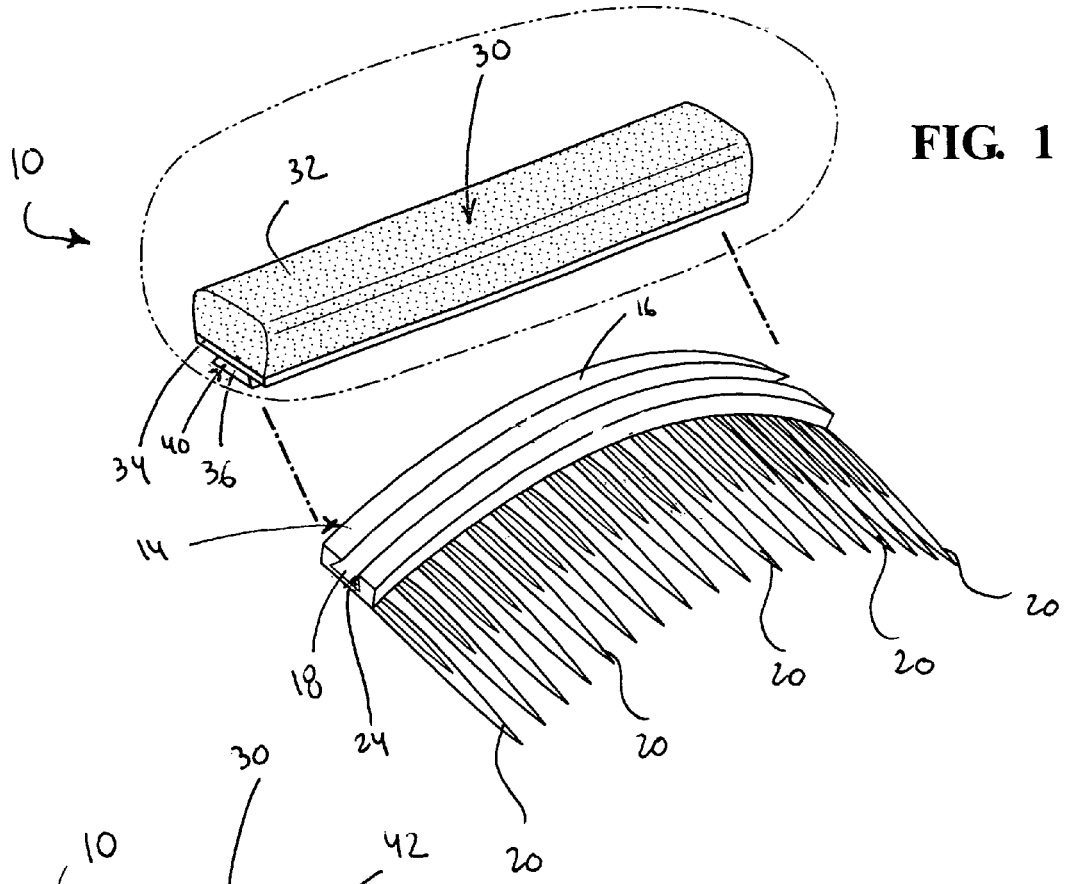
FIG. 1 illustrates a perspective view of a hair piece of the present invention illustrating a comb and a base portion each presenting female and male connectors, respectively.

Referring to the Figure, wherein like numerals indicate like or corresponding parts throughout the several views, a hair piece device (the device) of the present invention is generally shown at 10 FIGS. 1 through 4.

The device 10 includes a comb portion, generally indicated at 14, formed from a flexible polymeric material. The comb portion 14 includes a top portion 16 presenting a track or female connector 18 and a plurality of teeth 20 extending radially from the top portion for engaging hair of a user 22. The female connector 18 may include various configurations such as, for example, a circular, rectangular (both not shown), or, as most preferred by the scope of the present invention—a dove tail configuration, generally indicated at 24 in FIGS. 1 and 2, to provide better retaining mechanism as will be described in detailed further below. The comb portion 14 may be fabricated from many other materials in addition to polymeric material or combination thereof without limiting the scope of the present invention.

Figure 2:
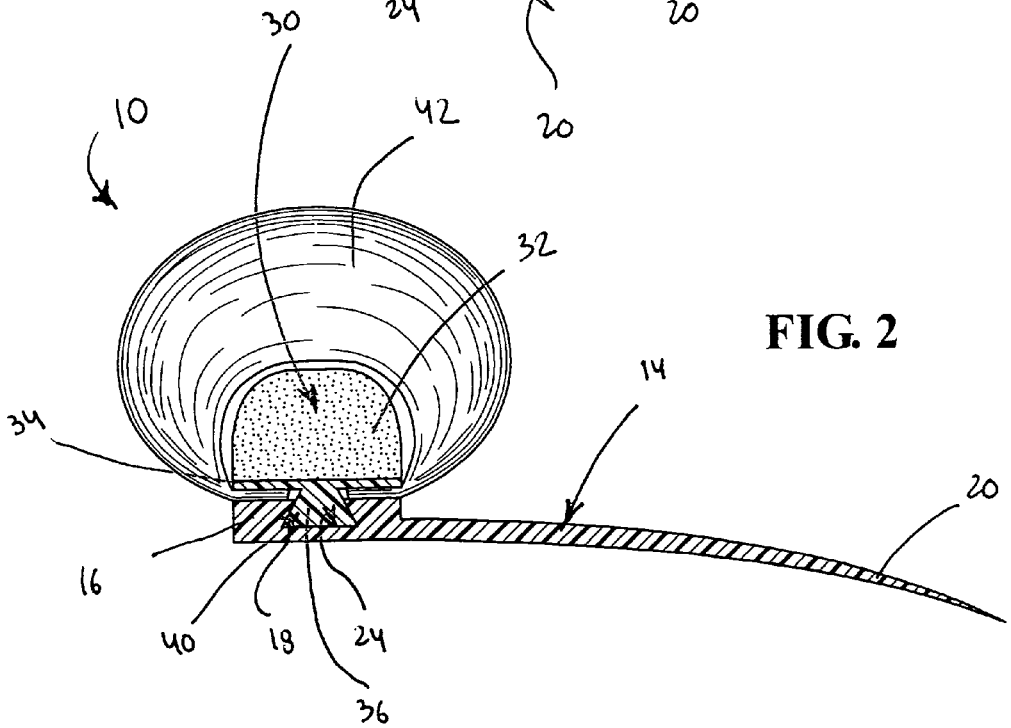
FIG. 2 illustrates a cross sectional view of the comb and the base portion of the present invention as shown in FIG. 1, wherein the base portion is mechanically engaged with the comb and a hair disposed above and around the base portion of the hair piece.
Figure 3:
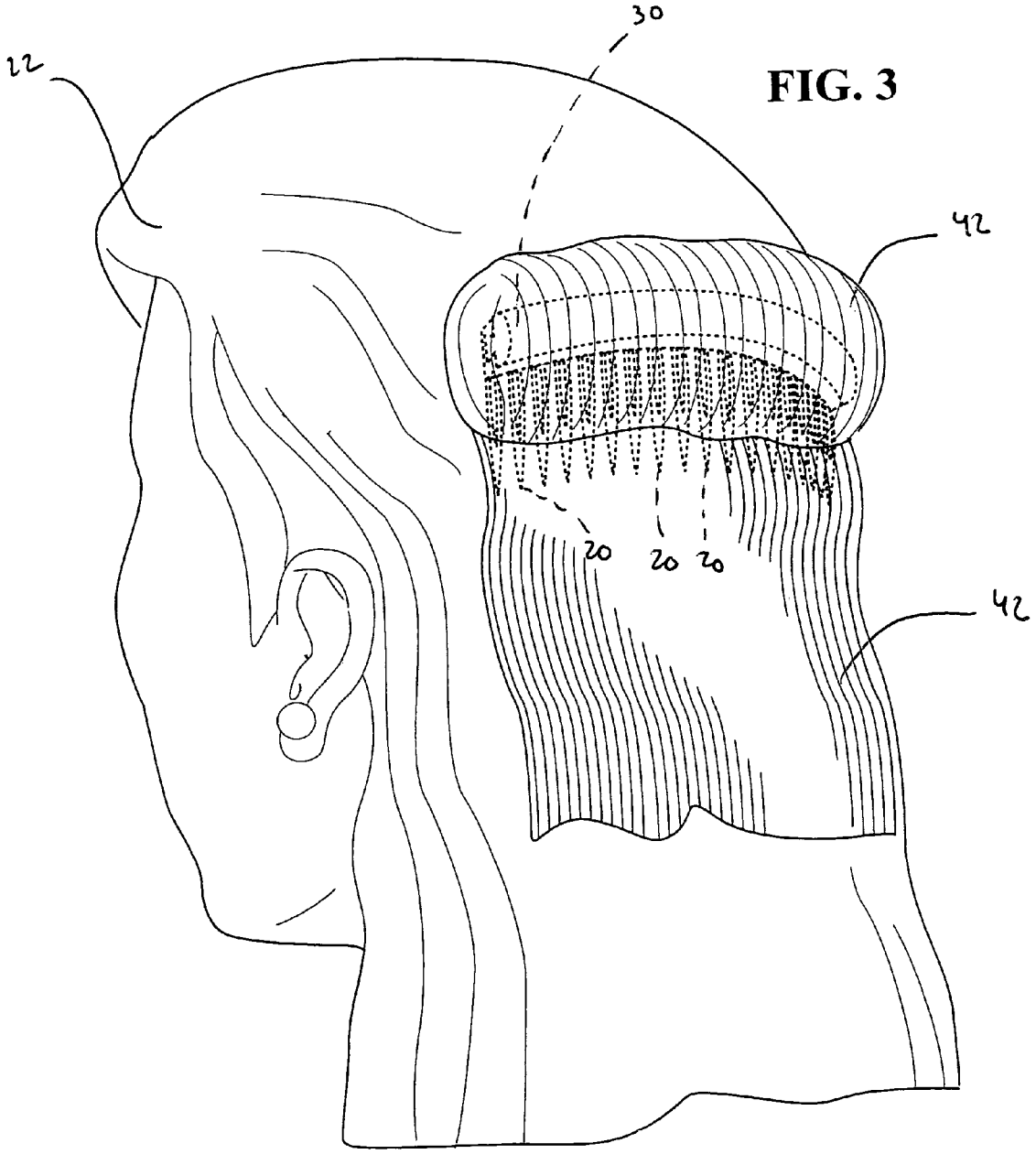
FIGS. 3 and 4 illustrates a back view of the user's head illustrating the hair piece device with various base portions having hair of different shapes, lengths, and styles.
Figure 4:
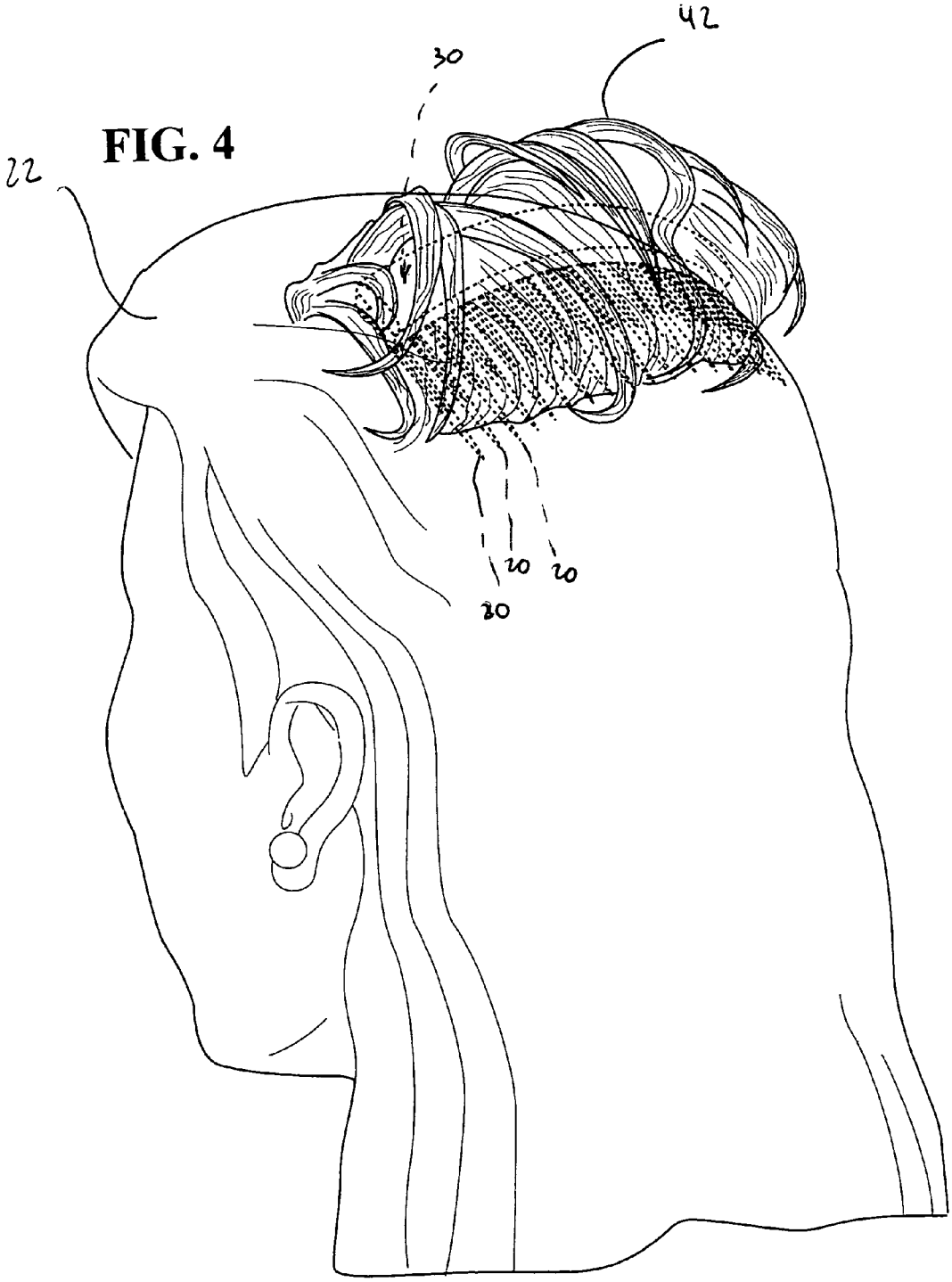

A base or support portion of the hair piece 10 is generally indicated at 30 in FIGS. 1 and 2. The base portion 30 formed from another polymeric material such as foam 32 or the like. The base portion 30 may present various cross sections such as circular, rectangular, square, and the like. The base portion 30 may present various length and heights as desired by the user 22. The base portion 30 includes a bottom 34 presenting a rail or a male connector 36 to slidably engage within the female connector 18 or track defined in the top portion 16 of the comb 14. The male connector 36 may include various configurations such as, for example, a circular, rectangular, or, as most preferred by the scope of the present invention—a dove tail configuration, as generally indicated at 40 in FIGS. 1 and 2, to provide better retaining mechanism as the male connector 36 of the base portion 30 is slidably disposed within the female connector 18 or track of the top portion 16 of the comb 14.

A human or synthetic hair of various shapes 42, styles and colors is connected to the base portion 30 thereby totally covering the base portion 30, as best shown in FIG. 2. Numerous base portions 30 may be utilized with the comb 14 of the present invention. As the height, shape and length of the bast portion 30 changes so does the color, style, and shape of hair. The single comb portion 14 may be used with the base portions 30 and hair 42 having various heights, styles, colors, and the like thereby providing the user with flexibility and choices not appreciated and realized by other prior art designs.

An advantage of the present invention is to provide the hair piece device 10 that the user to selectively change as the user desires, the color, shape, and the length of the hair in addition to the hair of the user. Another advantage of the present invention is to provide an improved set, such as the hair piece device 10 that will use a single comb portion and a plurality of base portions presenting various heights, length, shapes, and hair colors and styles thereby preventing the user to go to hairdresser every time the user wants to change the hairstyle thereby saving tremendous amounts of money by simply purchasing one set that includes a single comb portion and a plurality of base portions.

Still another advantage of the present invention is to provide the comb portion 14 and the base portions 30 that are easy to use, light in weight, and cost effective in manufacturing production. Still another advantage of the present invention is to provide the comb portion 14 and the base portions 30 that can be used by adults and children of all genders.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A hair piece device for selectively forming various hair shapes and styles as desired by a user, said hair piece device comprising:

a comb presenting a top portion including a single female connector formed in a center of said top portion and a plurality of radial teeth extending from said top portion for engaging the hair of the user, said female connector presents a dove tail cross section; and a base portion including a portion made of a foam material and a bottom portion having a single male connector extending from a center of said bottom portion;

hair connected to said base portion thereby totally covering said base portion;

a mechanical connection defined between said comb and said base portion as said single male connector slides into said female connector for selectively engaging said base portion with said comb as the user desires to change the color, shape, and the length of the hair in addition to the hair of the user, wherein said hair connected to said base portion and totally covering said base portion is fixed between said bottom portion of said base portion and said top portion of said comb.

2. A hair piece device as set forth in claim 1, wherein said comb is formed from polymeric material presenting flexible property.

3. A hair piece device as set forth in claim 2, wherein said single male connector is integral with said bottom portion, said male connector presents a dove tail cross section to mate with said single female connector of said comb thereby allowing the user to remove one of said base portion and replace with another base portion thereby changing the style, shape and lengths as desired by the user and increasing the volume of the hair of the user.

* * * * *